US009356354B2

(12) United States Patent
Yona

(10) Patent No.: US 9,356,354 B2
(45) Date of Patent: May 31, 2016

(54) COMPACT, BROADBAND, OMNI ANTENNA FOR INDOOR/OUTDOOR APPLICATIONS

(71) Applicant: GALTRONICS CORPORATION LTD., Tiberias (IL)

(72) Inventor: Haim Yona, Givat Avni (IL)

(73) Assignee: GALTRONICS CORPORATION, LTD, Tiberias (IL)

( * ) Notice: Subject to any disclaimer, the term of this patent is extended or adjusted under 35 U.S.C. 154(b) by 510 days.

(21) Appl. No.: 13/743,854

(22) Filed: Jan. 17, 2013

(65) Prior Publication Data

US 2014/0118209 A1 May 1, 2014

Related U.S. Application Data

(60) Provisional application No. 61/720,106, filed on Oct. 30, 2012.

(51) Int. Cl.
*H01Q 9/40* (2006.01)
*H01Q 13/04* (2006.01)

(52) U.S. Cl.
CPC . *H01Q 9/40* (2013.01); *H01Q 13/04* (2013.01)

(58) Field of Classification Search
CPC ... H01Q 13/04; H01Q 13/06; H01Q 13/0233; H01Q 9/40
USPC ..... 343/775
See application file for complete search history.

(56) References Cited

U.S. PATENT DOCUMENTS 5,926,150 A 7/1999 McLean et al.
6,255,998 B1 * 7/2001 Podger ..... 343/867
6,667,721 B1 12/2003 Simonds
2006/0109192 A1 5/2006 Weigand
2006/0164305 A1 7/2006 Chen et al.
2006/0187134 A1 * 8/2006 Hoshi ..... 343/773
2006/0284779 A1 12/2006 Parsche et al.
2007/0159408 A1 7/2007 Parsche

FOREIGN PATENT DOCUMENTS

EP 2490296 A1 * 8/2012 ..... H01Q 9/29

OTHER PUBLICATIONS

An International Search Report and a Written Opinion both dated Apr. 25, 2014, which issued during the prosecution of Applicant's PCT/IL13/50888.

U.S. Appl. No. 61/720,106, filed Oct. 30, 2012.

"A Brief History of UWB Antennas", Hans Gregory Schantz, The Proceedings of the 2003 IEEE UWBST Conference, 2003.

* cited by examiner

*Primary Examiner* — Hoang V Nguyen
*Assistant Examiner* — Michael Bouizza
(74) *Attorney, Agent, or Firm* — Ingrassia Fisher & Lorenz, P.C.

(57) ABSTRACT

An antenna, including a broadband bi-conical antenna including a lower antenna element and an upper conical antenna element, the lower antenna element including a lower conical antenna element and a meandered counterpoise element, which meandered counterpoise element is disposed at a base end of the lower conical antenna element and is integrally formed therewith, a reflector having a projection in a plane generally perpendicular to a vertical axis of the bi-conical radiating element, and a feed arrangement for feeding the bi-conical radiating element.

23 Claims, 4 Drawing Sheets

COMPACT, BROADBAND, OMNI ANTENNA FOR INDOOR/OUTDOOR APPLICATIONS

REFERENCE TO RELATED APPLICATIONS

Reference is made to U.S. Provisional Patent Application Ser. No. 61/720,106, filed Oct. 30, 2012 and entitled "A COMPACT, BROADBAND, OMNI ANTENNA FOR INDOOR/OUTDOOR APPLICATIONS", the disclosure of which is hereby incorporated by reference and priority of which is hereby claimed pursuant to 37 CFR 1.78(a) (4) and (5)(i).

FIELD OF THE INVENTION

The present invention relates generally to antennas and more particularly to broadband antennas for wireless communication.

BACKGROUND OF THE INVENTION

The following publication is believed to represent the current state of the art:

"A BRIEF HISTORY OF UWB ANTENNAS", Hans Gregory Schantz, The Proceedings of the 2003 IEEE UWBST Conference, 2003.

SUMMARY OF THE INVENTION

The present invention seeks to provide a novel compact broadband antenna, particularly suited for single-input single-output (SISO) performance.

There is thus provided in accordance with a preferred embodiment of the present invention an antenna, including a broadband bi-conical antenna including a lower antenna element and an upper conical antenna element, the lower antenna element including a lower conical antenna element and a meandered counterpoise element, which meandered counterpoise element is disposed at a base end of the lower conical antenna element and is integrally formed therewith, a reflector having a projection in a plane generally perpendicular to a vertical axis of the bi-conical radiating element, and a feed arrangement for feeding the bi-conical radiating element.

In accordance with a preferred embodiment of the present invention, the lower conical antenna element and the upper conical antenna element are each formed as a truncated cone having a truncated apex. Preferably, the upper conical antenna element is mounted above the lower conical antenna element by means of at least one supporting stand and spacer element. Preferably, the antenna also includes gamma matching elements for inducing a distributed shunt reactance between the upper conical antenna element and the lower antenna element. Preferably, the bi-conical antenna radiates an omnidirectional beam.

Preferably, the reflector forms a ground plane of said antenna. Preferably, the reflector is planar.

Preferably, the feed arrangement includes a port for feeding the upper conical antenna element. Preferably, the port is galvanically connected to the lower conical antenna element and to the upper conical antenna element.

Preferably, the lower conical antenna element and the upper conical antenna element have different heights. Preferably, the antenna operates as an inverted disc-cone antenna, wherein the disc portion of the inverted disc-cone antenna is implemented by the lower antenna element and the cone portion of the inverted disc-cone antenna is implemented by the upper conical antenna element. Preferably, the antenna is operable in a first mode of operation at frequencies between 1710-6000 MHz, wherein the meandering of the meandered counterpoise element provides heightened impedance, thereby effectively shortening the dimensions of the lower antenna element. Additionally, the meandered counterpoise element acts as a reflector which is operative to direct radiation into a volume defined by the upper conical antenna element.

Preferably, the antenna is also operable in a second mode of operation at frequencies between 690-960 MHz, wherein the conductor length of the lower antenna element is effectively increased by the meandered counterpoise element.

Preferably, the upper conical antenna element and the lower conical antenna element are vertically aligned along the vertical axis. Preferably, the antenna is housed within a radome, the radome being operative to protect the antenna from the environment.

Preferably, a multiplicity of holes are formed in the reflector and in the meandered counterpoise element and are mutually aligned therebetween, the holes being operable for at least one of attachment of reflector to a supporting surface, and attachment of the radome to the antenna.

Most preferably, a diameter of the meandered counterpoise element is 200 millimeters. Most preferably, the upper conical antenna element is preferably mounted 4.0 millimeters above the lower conical antenna element.

Most preferably, a distance between a base of the upper conical antenna element and the truncated apex thereof is 40.7 millimeters. Most preferably, a distance between a base of lower conical antenna element and truncated apex thereof is 26.5 millimeters.

Most preferably, a diameter of the base of the upper conical antenna element is 80.4 millimeters. Most preferably, an angle between a sloping surface of the upper conical antenna element and a plane intersecting the truncated apex thereof is 49 degrees. Most preferably, an angle between a sloping surface of the lower conical antenna element and a plane intersecting the truncated apex thereof is 29 degrees.

Preferably, the port is located on an underside of the reflector.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
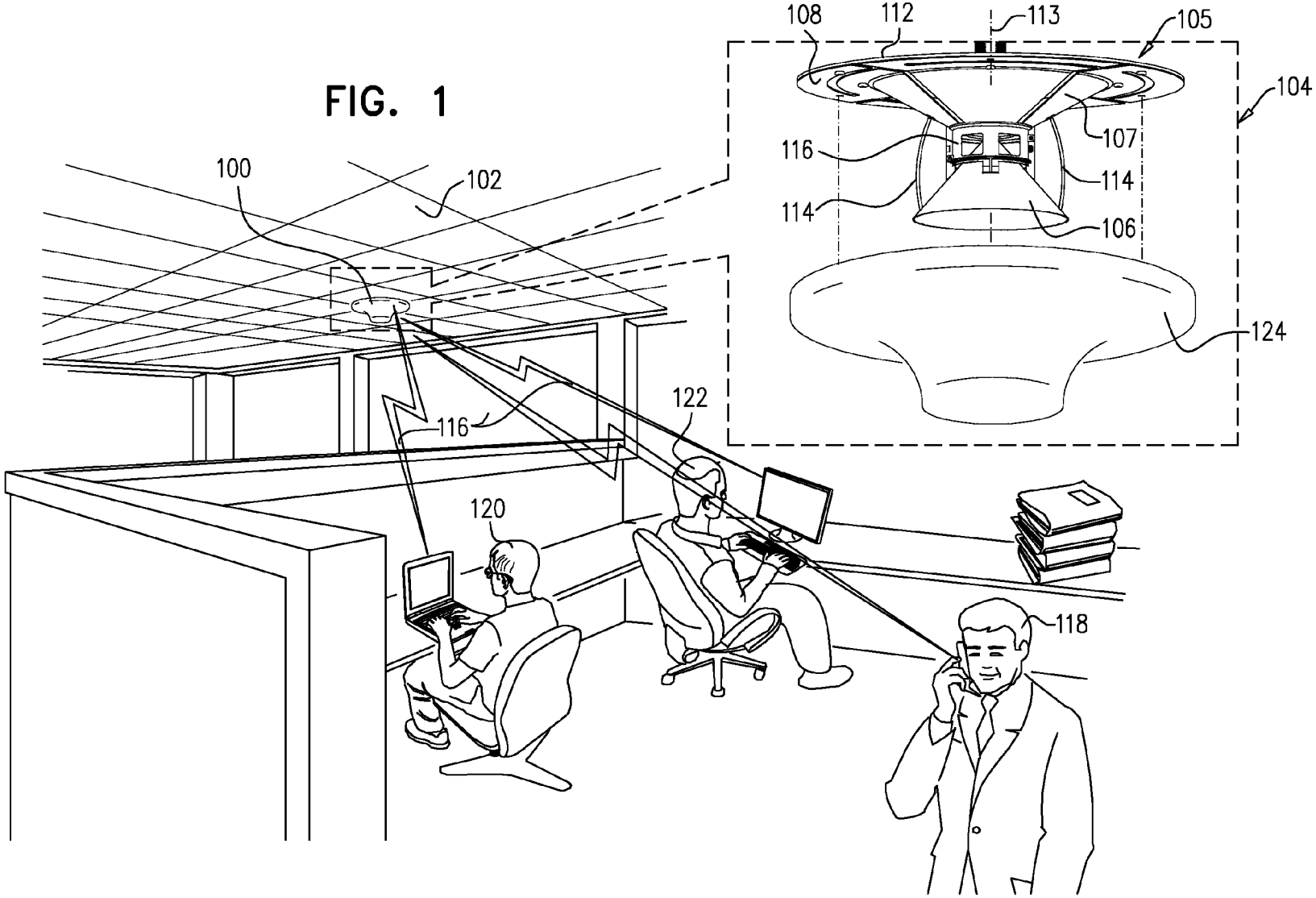
FIG. 1 is a schematic illustration of an antenna constructed and operative in accordance with a preferred embodiment of the present invention.

Reference is now made to FIG. 1, which is a schematic illustration of an antenna constructed and operative in accordance with a preferred embodiment of the present invention.

As seen in FIG. 1, there is provided an antenna 100. Antenna 100 is preferably an indoor-type antenna and is particularly preferably adapted for mounting on a ceiling 102. However, it is appreciated that antenna 100 may alternatively be adapted for mounting on a variety of indoor and/or outdoor surfaces, depending on the operating requirements of antenna 100.

As best seen at enlargement 104, antenna 100 is a broadband bi-conical antenna having a lower antenna element 105 and an upper conical antenna element 106. Lower antenna element 105 preferably comprises a lower conical antenna element 107 and a meandered counterpoise element 108, which meandered counterpoise element 108 is preferably disposed at a base end of lower conical antenna element 107 and is preferably integrally formed therewith. Lower conical antenna element 107 is preferably disposed on an upper surface of a reflector 112, which reflector 112 preferably forms a ground plane of antenna 100 and has a projection in a plane generally perpendicular to a vertical axis 113 of antenna 100. It is appreciated that conical antenna elements 106 and 107 are preferably formed as truncated cones.

It is a particular feature of a preferred embodiment of the antenna of the present invention that lower antenna element 105 and upper antenna element 106 are of different heights, thereby enabling two modes of operation of antenna 100.

Antenna 100 preferably operates as an inverted disc-cone antenna, wherein a disc portion of the antenna is provided by lower antenna element 105 and a cone portion of the antenna is provided by upper conical antenna element 106. In a first mode of operation at relatively high frequencies such as 1710-6000 MHz, the meandering of meandered counterpoise element 108 provides relatively high impedance, thereby effectively shortening the electrical length of lower conical antenna element 107 of lower antenna element 105. Furthermore, it is appreciated that counterpoise element 108 acts as a reflector which is operative to direct radiation into the volume defined by upper conical antenna element 106.

In a second mode of operation at relatively low frequencies such as 690-960 MHz, the electrical length of lower conical antenna element 107 of lower antenna element 105 is effectively increased by meandered counterpoise element 108. The added length allows antenna 100 to function at lower frequencies without significantly increasing the dimensions of the antenna.

A pair of gamma matching elements 114 preferably induces a distributed shunt reactance in both the first and second modes of operation, which distributed shunt reactance increases the radiation resistance and thereby improves the input match while maintaining omni azimuth coverage. It is a particular feature of a preferred embodiment of the antenna of the present invention that the use of multiple gamma matching elements 114 serves to prevent perturbation of the radiated pattern, which perturbation is typically formed when implementing a single gamma matching element with axially symmetric radiators such as elements 105 and 106.

A plurality of outer supporting stand and spacer elements 116 are preferably provided for mounting upper conical antenna element 106 above lower conical antenna element 107 of lower antenna element 105. The apexes of upper conical antenna element 106 and of lower conical antenna element 107 are preferably aligned along axis 113.

It is appreciated that meandered counterpoise element 108 is operative to mix the polarization of the radiated field and to thereby provide for omnidirectional beam patterns of antenna 100. This property is especially beneficially in SISO systems where the orientations and sensitivities of each of the receivers to each polarization are unknown.

Due to the omnidirectional beam patterns of antenna 100, antenna 100 is operative to serve a multiplicity of users, such as users 118, 120 and 122, with high RF data throughput rates and minimal fading and scattering effects. Furthermore, antenna 100 is extremely compact and relatively simple and inexpensive to manufacture in comparison to conventional SISO antennas.

Antenna 100 may optionally be housed by a radome 124, which radome 124 preferably has both aesthetic and protective functions. Radome 124 may be formed of any suitable material that does not distort the preferred radiation patterns of antenna 100.

Figure 2:
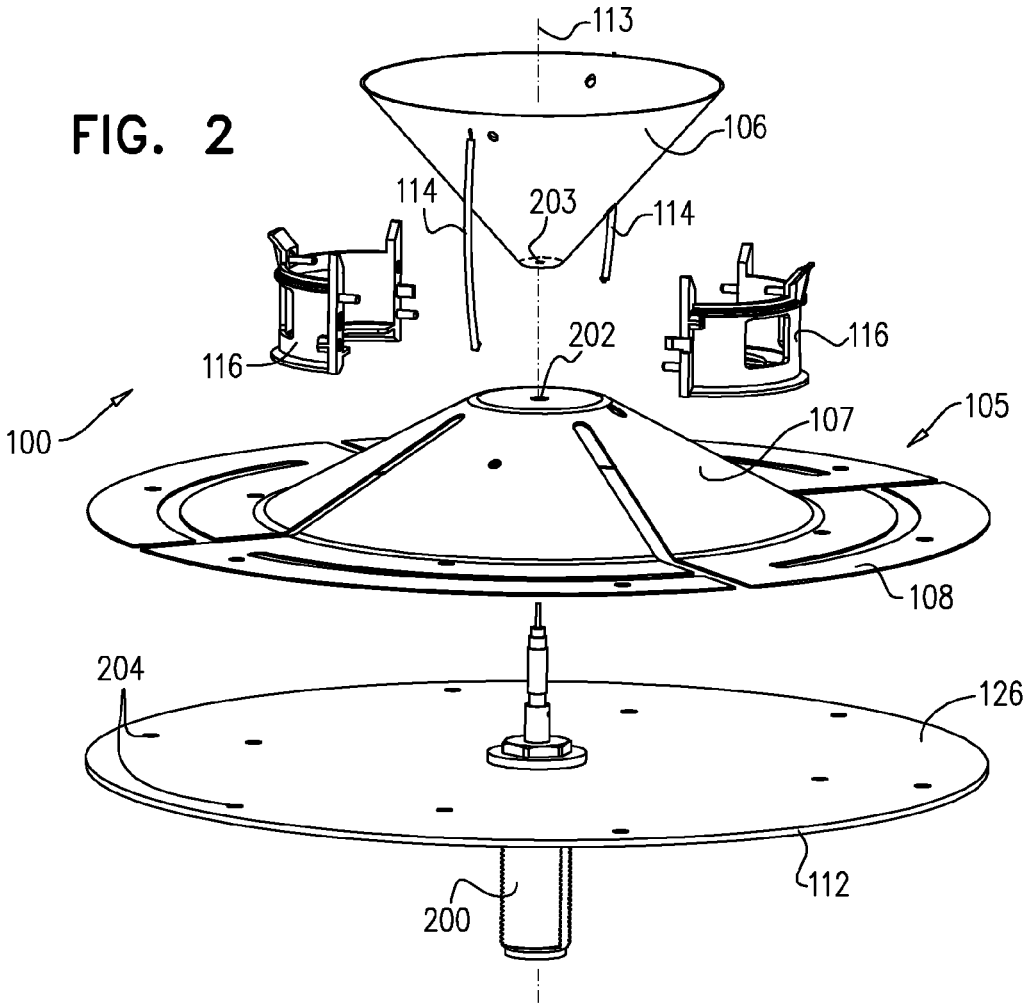
FIG. 2 is a simplified perspective exploded view illustration of an antenna of the type illustrated in FIG. 1.
Figure 3:
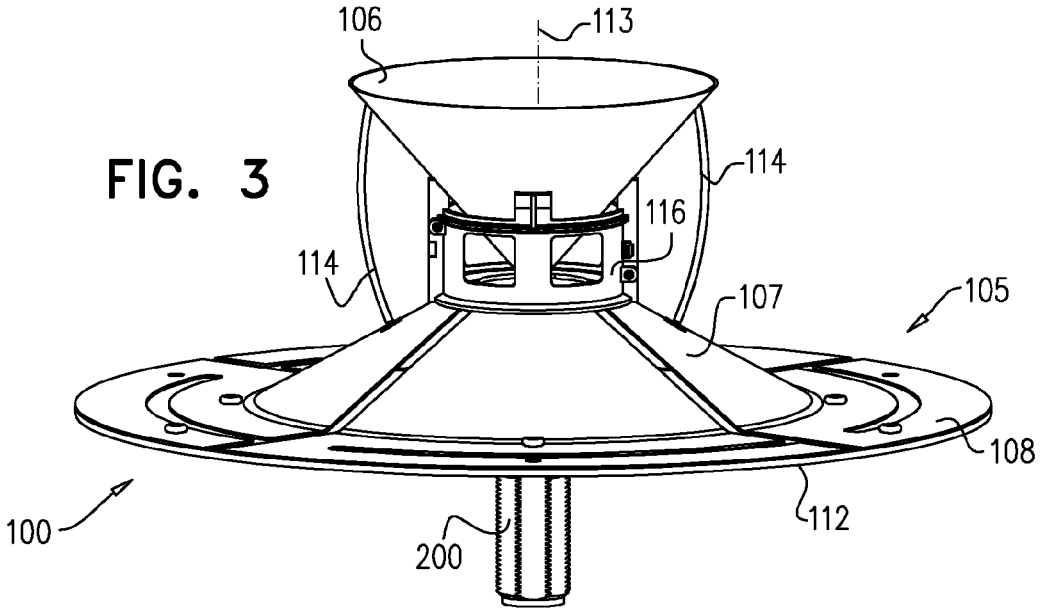
FIG. 3 is a simplified perspective assembled view illustration of an antenna of the type illustrated in FIG. 1.

Reference is now made to FIG. 2, which is a simplified perspective exploded view illustration of an antenna of the type illustrated in FIG. 1, and to FIG. 3, which is a simplified perspective assembled view illustration of an antenna of the type illustrated in FIG. 1.

As seen in FIGS. 2 & 3, and as described hereinabove with regard to FIG. 1, antenna 100 is a bi-conical antenna having a lower antenna element 105 and an upper conical antenna element 106. Lower antenna element 105 preferably comprises a lower conical antenna element 107 and a meandered counterpoise element 108 disposed at a base end of lower conical antenna element 107 which is preferably integrally formed therewith. Lower conical antenna element 107 is preferably disposed on an upper surface 126 of reflector 112, which reflector 112 preferably forms a ground plane of antenna 100 and has a projection in a plane generally perpendicular to vertical axis 113 of antenna 100. As clearly seen in FIG. 2, conical antenna elements 106 and 107 are formed as truncated cones.

Gamma matching elements 114 are preferably provided for inducing a distributed shunt reactance between upper conical antenna element 106 and lower antenna element 105, and which shunt reactance is operative to increase the radiation resistance and input match while maintaining omni azimuth coverage.

Outer supporting stand and spacer elements 116 are preferably provided for mounting upper conical antenna element 106 above lower conical antenna element 107 of lower antenna element 105. The apexes of conical antenna element 106 and lower conical antenna element 107 are preferably aligned along axis 113.

In operation of antenna 100, each of upper conical antenna element 106 and lower conical antenna element 107 preferably receives an RF input signal by way of a feed port 200. Feed port 200 preferably protrudes through a first aperture (not shown) formed in reflector 112 and is preferably galvanically connected to lower conical antenna element 107 by means of a second aperture 202 formed in lower conical antenna element 107 and to upper conical antenna element 106 by means of a third aperture 203 formed in upper conical antenna element 106. Port 200 is preferably located on an underside of reflector 112, opposite to surface 126 on which elements 105 and 106 are preferably located.

A multiplicity of holes 204 are optionally formed in reflector 112 and in meandered counterpoise element 108 and are mutually aligned therebetween. Holes 204 preferably facilitate the attachment of reflector 112 to a supporting surface, such as ceiling 102 seen in FIG. 1. Holes 204 may also be used for the optional attachment of a radome to antenna 100, such as radome 124 illustrated in FIG. 1.

Figure 4:
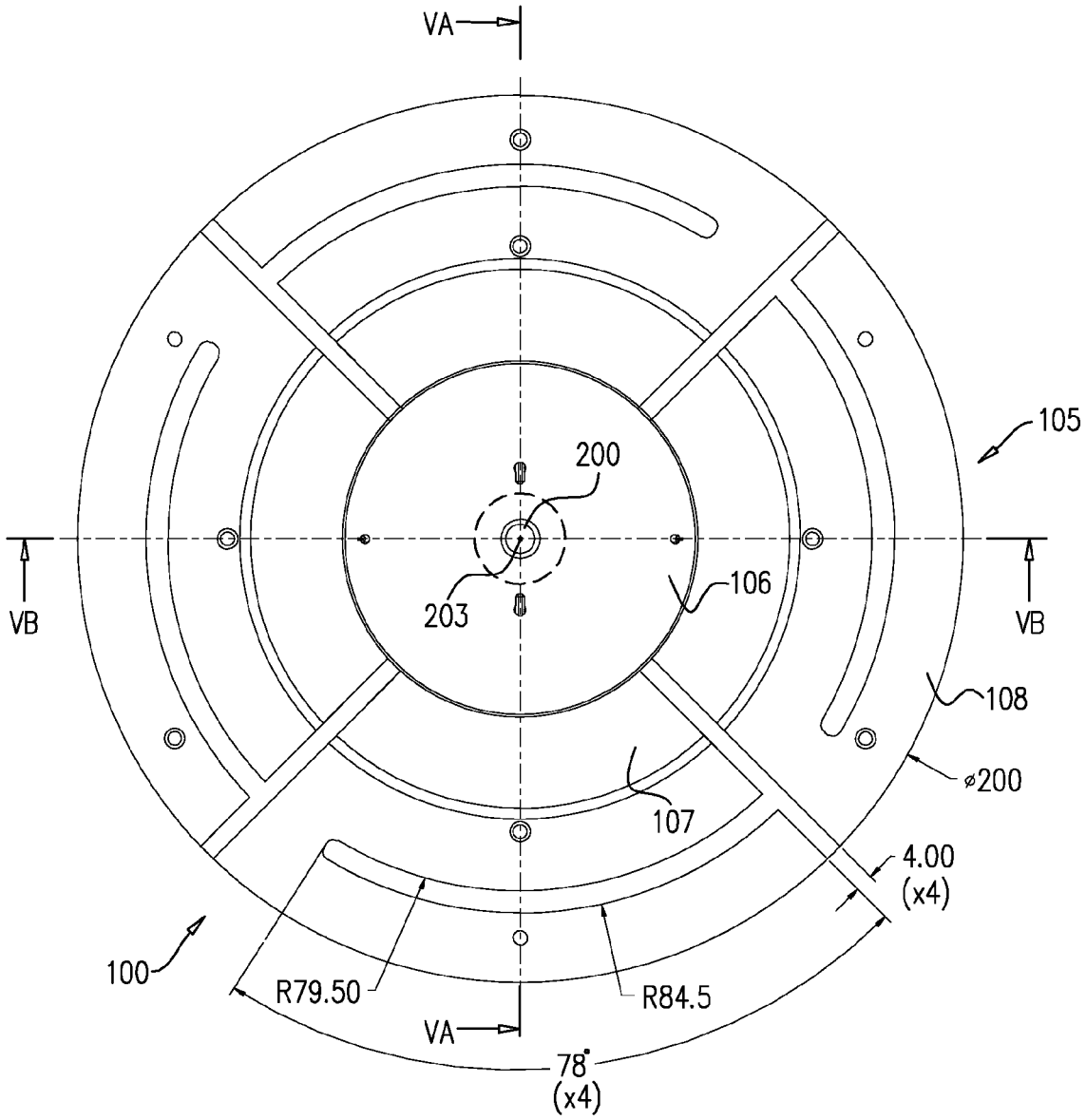
FIG. 4 is a simplified top view illustration of an antenna of the type illustrated in FIG. 1.

Reference is now made to FIG. 4, which is a simplified top view illustration of an antenna of the type illustrated in FIG. 1.

As seen in FIG. 4, and as described hereinabove with regard to FIG. 1, antenna 100 is a bi-conical antenna having a lower antenna element 105 and an upper conical antenna element 106. Lower antenna element 105 preferably comprises a lower conical antenna element 107 and a meandered counterpoise element 108 disposed at a base end of lower conical antenna element 107 which is preferably integrally formed therewith. Lower conical antenna element 107 is preferably disposed on upper surface 126 of reflector 112, which reflector 112 preferably forms a ground plane of antenna 100. Upper conical antenna element 106 is preferably mounted above lower conical antenna element 107 of lower antenna element 105. The apexes of conical antenna element 106 and lower conical antenna element 107 are preferably aligned along axis 113.

In operation of antenna 100, upper conical antenna element 106 preferably receives an RF input signal by way of feed port 200. A multiplicity of mutually aligned holes 204 are optionally formed in reflector 112 and in meandered counterpoise element 108, in order to facilitate the attachment of reflector 112 to a supporting surface, such as ceiling 102 seen in FIG. 1. Holes 204 may also be used for the optional attachment of a radome to antenna 100, such as radome 124 illustrated in FIG. 1.

Most preferably, the diameter of meandered counterpoise element 108 is 200 millimeters, as clearly shown in FIG. 4.

Figure 5A:
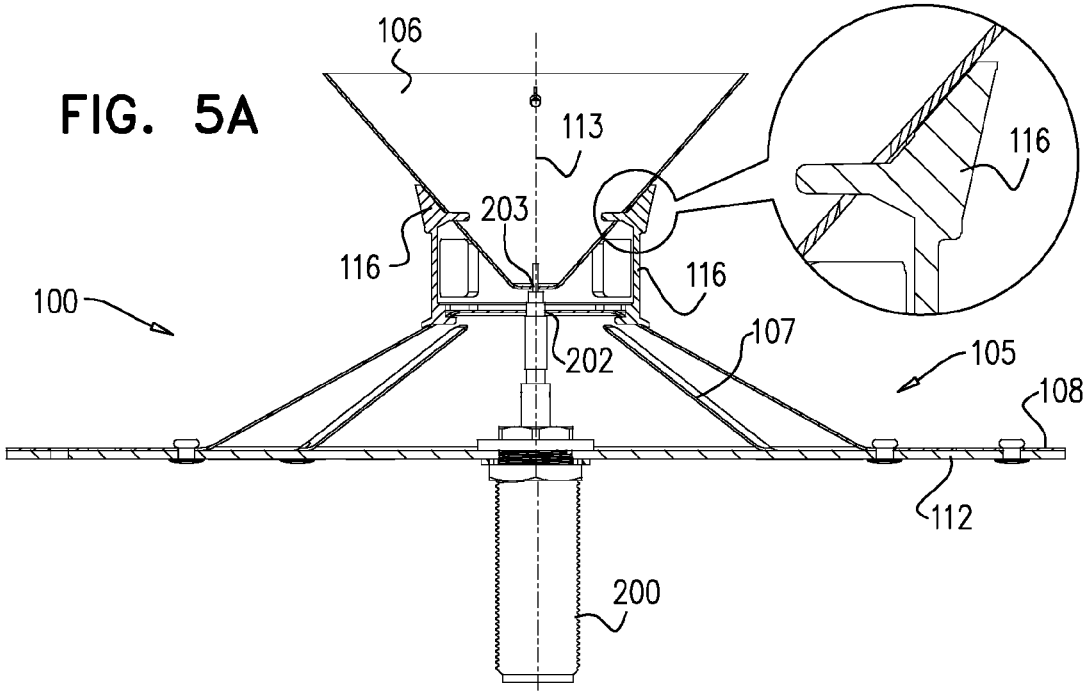
FIGS. 5A and 5B are simplified cross-sectional view illustrations of an antenna of the type illustrated in FIG. 1.
Figure 5B:
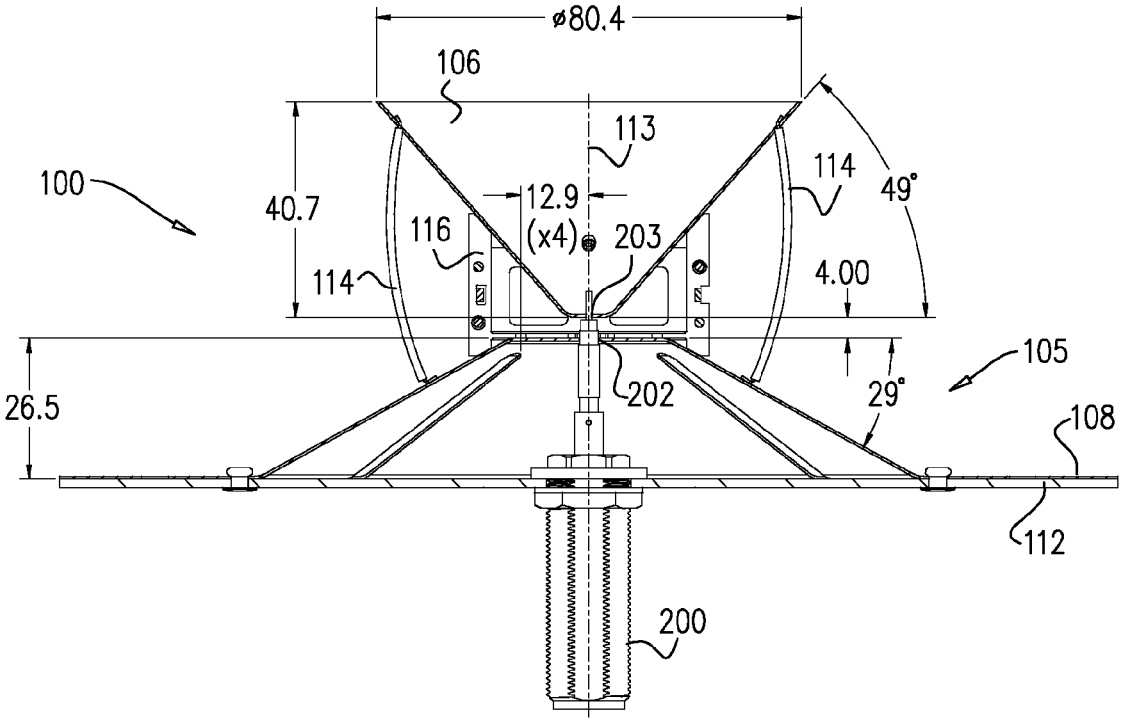

Reference is now made to FIGS. 5A and 5B, which are simplified cross-sectional view illustrations of an antenna of the type illustrated in FIG. 1.

As seen in FIGS. 5A and 5B, and as described hereinabove with regard to FIG. 1, antenna 100 is a bi-conical antenna having a lower antenna element 105 and an upper conical antenna element 106. Lower antenna element 105 preferably comprises a lower conical antenna element 107 and a meandered counterpoise element 108 disposed at a base end of lower conical antenna element 107 which is preferably integrally formed therewith. Lower conical antenna element 107 is preferably disposed on upper surface 126 of reflector 112, which reflector 112 preferably forms a ground plane of antenna 100 and has a projection in a plane generally perpendicular to vertical axis 113 of antenna 100. As clearly seen in FIGS. 5A and 5B, conical antenna elements 106 and 107 are formed as truncated cones.

Gamma matching elements 114 are preferably provided for inducing a distributed shunt reactance which increases the radiation resistance and input match while maintaining omni azimuth coverage.

Outer supporting stand and spacer elements 116 are preferably provided for mounting upper conical antenna element 106 above lower conical antenna element 107 of lower antenna element 105. Upper conical antenna element 106 is most preferably mounted 4.0 millimeters above lower conical antenna element 107. The truncated apexes of conical antenna element 106 and lower conical antenna element 107 are preferably aligned along axis 113.

Most preferably, the distance between the base of upper conical antenna element 106 and its truncated apex is 40.7 millimeters. Most preferably, the distance between the base of lower conical antenna element 107 and its truncated apex is 26.5 millimeters.

Most preferably, the diameter of the base of upper conical antenna element 106 is 80.4 millimeters.

Most preferably, the angle between the sloping surface of upper conical antenna element 106 and a plane intersecting the truncated apex thereof is 49 degrees. Most preferably, the angle between the sloping surface of lower conical antenna element 107 and a plane intersecting the truncated apex thereof is 29 degrees.

In operation of antenna 100, each of upper conical antenna element 106 and lower conical antenna element 107 preferably receives an RF input signal by way of feed port 200. Feed port 200 preferably protrudes through a first aperture (not shown) formed in reflector 112 and is preferably galvanically connected to lower conical antenna element 107 by means of second aperture 202 formed in lower conical antenna element 107 and to upper conical antenna element 106 by means of third aperture 203 formed in upper conical antenna element 106. Port 200 is preferably located on an underside of reflector 112, opposite to surface 126 on which elements 105 and 106 are preferably located.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

The invention claimed is:

1. An antenna, comprising:

a broadband bi-conical antenna comprising a lower antenna element and an upper conical antenna element, said lower antenna element comprising a lower conical antenna element and a meandered counterpoise element, which meandered counterpoise element is disposed at a base end of said lower conical antenna element and is integrally formed therewith;

a reflector having a projection in a plane generally perpendicular to a vertical axis of said bi-conical radiating element;

a pair of gamma matching elements for inducing a distributed shunt reactance between said upper conical antenna element and said lower antenna element, said pair of gamma matching elements comprising a first and a second gamma matching element being symmetrically arranged with respect to said vertical axis, a first end of each one of said first and second gamma matching elements being connected to said upper conical antenna element, a second end of each one of said first and second gamma matching elements being connected to said lower conical antenna element; and a feed arrangement for feeding said bi-conical radiating element, said feed arrangement comprising a port, said port comprising a feeding cable having an inner element connected to said upper conical antenna element and an outer element connected to said lower conical antenna element.

2. An antenna according to claim 1 and wherein said lower conical antenna element and said upper conical antenna element are each formed as a truncated cone having a truncated apex.

3. An antenna according to claim 2 and wherein said upper conical antenna element is mounted above said lower conical antenna element by means of at least one supporting stand and spacer element.

4. An antenna according to claim 1 and wherein said bi-conical antenna radiates an omnidirectional beam.

5. An antenna according to claim 1 and wherein said reflector forms a ground plane of said antenna.

6. An antenna according to claim 5 and wherein said reflector is planar.

7. An antenna according to claim 1 and wherein said port is galvanically connected to said lower conical antenna element and to said upper conical antenna element.

8. An antenna according to claim 2 and wherein said lower conical antenna element and said upper conical antenna element have different heights.

9. An antenna according to claim 1 and wherein said antenna operates as an inverted disc-cone antenna, wherein a disc portion of said inverted disc-cone antenna is implemented by said lower antenna element and a cone portion of said inverted disc-cone antenna is implemented by said upper conical antenna element.

10. An antenna according to claim 1 and wherein said antenna is operable in a first mode of operation at frequencies between 1710 - 6000 MHz, wherein the meandering of said meandered counterpoise element provides heightened impedance, thereby effectively shortening the dimensions of said lower antenna element.

11. An antenna according to claim 9 and wherein said meandered counterpoise element acts as a reflector which is operative to direct radiation into a volume defined by said upper conical antenna element.

12. An antenna according to claim 9 and wherein said antenna is operable in a second mode of operation at frequencies between 690 - 960 MHz, wherein the conductor length of said lower antenna element is effectively increased by said meandered counterpoise element.

13. An antenna according to claim 1 and wherein said upper conical antenna element and said lower conical antenna element are vertically aligned along said vertical axis.

14. An antenna according to claim 1 and wherein said antenna is housed within a radome, said radome being operative to protect said antenna from the environment.

15. An antenna according to claim 14 and wherein a multiplicity of holes are formed in said reflector and in said meandered counterpoise element and are mutually aligned therebetween, said holes being operable for at least one of attachment of reflector to a supporting surface, and attachment of said radome to said antenna.

16. An antenna according to claim 1 and wherein a diameter of said meandered counterpoise element is 200 millimeters.

17. An antenna according to claim 1 and wherein said upper conical antenna element is mounted 4.0 millimeters above said lower conical antenna element.

18. An antenna according to claim 2 and wherein a distance between a base of said upper conical antenna element and said truncated apex thereof is 40.7 millimeters.

19. An antenna according to claim 2 and wherein a distance between a base of lower conical antenna element and said truncated apex thereof is 26.5 millimeters.

20. An antenna according to claim 1 and wherein a diameter of the base of said upper conical antenna element is 80.4 millimeters.

21. An antenna according to claim 2 and wherein an angle between a sloping surface of said upper conical antenna element and a plane parallel to said truncated apex thereof is 49 degrees.

22. An antenna according to claim 2 and wherein an angle between a sloping surface of said lower conical antenna element and a plane parallel to the said truncated apex thereof is 29 degrees.

23. An antenna according to claim 1 and wherein said port is located on an underside of said reflector.

* * * * *